US006567063B1

(12) United States Patent
Okita

(10) Patent No.: US 6,567,063 B1
(45) Date of Patent: May 20, 2003

(54) HIGH-SPEED DRIVING METHOD OF A LIQUID CRYSTAL

(75) Inventor: Masaya Okita, Yono (JP)

(73) Assignees: Hunet, Inc., Tokyo (JP); Masaya Okita, Tokyo (JP)

( * ) Notice: Subject to any disclaimer, the term of this patent is extended or adjusted under 35 U.S.C. 154(b) by 0 days.

(21) Appl. No.: 09/285,895

(22) Filed: Apr. 8, 1999

(30) Foreign Application Priority Data

Apr. 10, 1998 (JP) ..... 10-116057

(51) Int. Cl.[7] ..... G09G 3/36
(52) U.S. Cl. ..... 345/94; 345/102
(58) Field of Search ..... 345/89, 95, 147, 345/102, 150, 94, 96; 252/299.62

(56) References Cited

U.S. PATENT DOCUMENTS

| | | | | |
|---|---|---|---|---|
| 3,902,169 | A | | 8/1975 | Washizuka |
| 4,084,884 | A | | 4/1978 | Raynes |
| 4,608,558 | A | | 8/1986 | Amstutz et al. |
| 4,634,226 | A | | 1/1987 | Isogai et al. |
| 4,681,404 | A | | 7/1987 | Okada et al. |
| 4,687,956 | A | | 8/1987 | Itoh et al. |
| 4,795,239 | A | | 1/1989 | Yamashita et al. |
| 4,836,656 | A | | 6/1989 | Mouri et al. |
| 4,962,376 | A | | 10/1990 | Inoue et al. |
| 5,117,298 | A | * | 5/1992 | Hirai ..... 359/55 |
| 5,264,952 | A | | 11/1993 | Fukutani et al. |
| 5,300,945 | A | | 4/1994 | Iemoto et al. |
| 5,323,172 | A | | 6/1994 | Koden |
| 5,459,481 | A | * | 10/1995 | Tanaka et al. ..... 345/95 |
| 5,543,947 | A | | 8/1996 | Mase et al. |
| 5,594,464 | A | | 1/1997 | Tanaka et al. |
| 5,648,793 | A | | 7/1997 | Chen |
| 5,684,503 | A | | 11/1997 | Nomura et al. |
| 5,694,147 | A | | 12/1997 | Gaalema et al. |
| 5,748,170 | A | | 5/1998 | Goto |
| 5,777,591 | A | | 7/1998 | Katoh et al. |
| 5,777,593 | A | * | 7/1998 | Kondoh ..... 345/97 |
| 5,922,242 | A | * | 7/1999 | Saishu et al. ..... 252/299.62 |
| 5,953,002 | A | * | 9/1999 | Hirai et al. ..... 345/204 |
| 6,023,131 | A | | 2/2000 | Okita |
| 6,057,817 | A | * | 2/2000 | Ono et al. ..... 345/94 |
| 6,151,006 | A | * | 11/2000 | Yanagi et al. ..... 345/94 |
| 6,154,191 | A | | 11/2000 | Okita |
| 6,396,467 | B1 | | 5/2002 | Okita |
| 6,424,329 | B1 | | 7/2002 | Okita |
| 2001/0052885 | A1 | | 12/2001 | Okita |
| 2002/0057246 | A1 | | 5/2002 | Okita |

FOREIGN PATENT DOCUMENTS

| | | |
|---|---|---|
| JP | 62-253126 | 11/1987 |
| JP | 1-179914 | 7/1989 |

* cited by examiner

*Primary Examiner*—Amare Mengistu
(74) *Attorney, Agent, or Firm*—Flynn, Thiel, Boutell & Tanis, P.C.

(57) ABSTRACT

In order to drive a liquid crystal at a speed equivalent to or higher than CRT displays, in a liquid crystal display device made of a liquid crystal and two electrodes sandwiching the liquid crystal to display images by applying a voltage based on gradation data between the two electrodes, a predetermined voltage independent from the gradation data is applied across the two electrodes for a predetermined length of time in predetermined intervals.

35 Claims, 4 Drawing Sheets

HIGH-SPEED DRIVING METHOD OF A LIQUID CRYSTAL

FIELD OF THE INVENTION

1. Field of the Invention

This invention relates to a high-speed driving method of a liquid crystal for driving a liquid crystal, particularly for gradation display, at a high speed.

2. Related Art

As already known, when two transparent flat plates having transparent electrodes and sandwiching a liquid crystal are placed between two polar zigplates, transmittance of light passing through the polarizing plates changes with the voltage applied across the transparent electrodes.

Since liquid crystal display devices based on the above principle can be shaped flat and are operative with low electric power, they have been widely used in wrist watches, electronic calculating machines, and so forth.

In recent years, they are also used in combination with color filters to make up color display devices in note-type personal computers and small liquid crystal TV sets, for example.

In liquid crystal display devices combined with color filters to display color images, three dots of different colors, namely, red, green and blue, are combined to display desired colors.

A problem with the use of color filters lies in that color filters are very expensive and need a high accuracy when bonded to panels. Moreover, they need a triple number of dots to ensure an equivalent resolution as compared with black-and-white liquid crystal display panels. Therefore, typical liquid crystal color panels require a triple number of drive circuits in the horizontal direction. This means an increase of the cost of drive circuits themselves and the cost for an increased man-hour for connecting drive circuits to the panel at a triple number of points.

Another problem with the use of color filters is their optical transmittance as low as 20% approximately. When color filters are used, the brightness decreases to approximately one fifth, and a large amount of electric power is consumed for back-lighting to compensate the brightness.

There is another problem in conventional liquid crystal devices, namely, slow responses of liquid crystals. In this respect, liquid crystal display devices have been inferior to CRT displays especially when used as TV displays for displaying moving images or as personal computer displays required to quickly follow the movements of a mouse cursor.

Japanese Patent Laid-Open Publication No. hei 1-179914 discloses a color liquid crystal display device to display color images by combining a black-and-white panel and tricolor back-lighting instead of using color filters. This method may enable realization of high-fidelity color images inexpensively, as compared with the method using color filters. In order to realize images without flickers, this method needs an ON-OFF frequency of each color backlight as high as 40 Hz or more, and more preferably 60 Hz or more. As a result, the frequency of liquid crystal display becomes thrice that frequency, namely, 180 Hz, and the cycle of liquid crystal display becomes 5.5 ms. Regarding the ON time of backlight, it must be at least 2 ms, which is two fifths the display cycle, to ensure that a display luminance equivalent to that obtained by using one white fluorescent lamp be obtained by three color tubes, one for each of red, green and blue colors, considering that, when cold cathode ray tubes, such as those using red, green and blue short-afterglow fluorescent materials, optical conversion efficiency relative to input power decreases nearly to a half, but the transmittance increases to five times due to removal of color filters. Therefore, if the duration of 2 ms of the display period 5.5 ms is used for turning on the backlight, then the response speed of the liquid crystal panel is high enough to stabilize liquid crystal display within 3.5 ms. When a graphic image on a display is scanned, for example, even at a high scanning speed as high as 1000 Hz to prevent color striation or defective coloring on the screen, additional 1 ms is further required, and the response speed of the liquid crystal panel must be higher enough to stabilize liquid crystal display within 2.5 ms.

However, in case of liquid crystal display devices using typical nematic TN liquid crystal such as TN liquid crystal or STN liquid crystal, for example, their response speeds are as slow as decades of ms to hundreds of ms.

There are some other proposals to use ferroelectric liquid crystals or anti-ferroelectric liquid crystals to provide liquid crystal panels operative at a high speed. However, no such device has been brought into practice mainly because cell gaps of the liquid crystal must as small as 1 $\mu$m or less and are therefore difficult to make. It is known, as means for increasing the response speed of a liquid crystal panel, that the response speed is increased in inverse proportion to the square of the cell gap when the cell gap is narrowed. In case of TN liquid crystals, the response speed can be readily increased to 2 through 3 ms or less by selecting a low-viscosity liquid crystal material and narrowing the cell gap to 2 $\mu$m. Even when the cell gap is as narrow as 2 $\mu$m, there is an allowance of $\pm 0.4$ $\mu$m for acceptably uniform display, and large-scale panels can be manufactured without serious problems. Therefore, eight-color display with two tones for each color can be realized by using three-color back-lighting and using a narrow-gap TN liquid crystal.

Liquid crystal display devices are more and more widely used as display devices for personal computers in lieu of CRT displays to save the space and electric power. More and more applications for personal computers are designed for multi-color display, and display devices are required to display 16,777,216 colors with 256 tones for each color. Also for use other than personal computers, video images require multi-color display of 64 tones for each color.

There are some schemes for gradation display of liquid crystal panels, such as a method using a voltage to control color gradation or tones in case of liquid crystals like TN liquid crystals or anti-ferroelectric liquid crystals exhibiting relatively moderate changes in transmittance with voltage, a method for display by changing the ratio between the time for display white and the time for displaying black or a method for collecting and averaging a plurality of pixels, in case of liquid crystals such as STN liquid crystals or ferroelectric liquid crystals having only two values of transmittance relative to voltage. However, in the color display method using three-color back-lighting, since the display cycle is relatively short, the method by changing the ratio of white and black display periods of time cannot provide a desired number of tones because the operation frequency of the control circuit increases too high. The method by collecting and averaging a plurality of dots removes the merit of reducing the number of pixels to one third as compared to the color-filter method.

Therefore, in order to realize multi-color display by the color display method using three-color back-lighting, control of tones by voltage control must be used. However, response speeds of liquid crystal panels, in general, are such that changes to or from an intermediate tone are slower by several times or more than changes from white to black or from black to white.

SUMMARY OF THE INVENTION

It is therefore an object of the invention to provide a high-speed driving method of a liquid crystal, which increases the response speed sufficiently to enable color display by three-color back-lighting or promise a performance equivalent to or higher than that of CRT displays in reproduction of moving images.

According to the invention, there is provided a high-speed driving method of a liquid crystal for a liquid crystal display device made up of a liquid crystal and two electrodes sandwiching the liquid crystal to display images by applying a voltage based on gradation data between the two electrodes, characterized in applying a predetermined voltage independent from said gradation data across said two electrodes for a predetermined length of time in predetermined intervals.

Especially in color display using three-color back-lighting, it is remarked that the duration of time where all of three color backlight lamps are OFF comes about periodically. By using the fact that, in the duration of time where all of the three color backlight lamps are OFF, the quality of images is not affected by any state of transmittance of the liquid crystal panel, and by applying a voltage to the liquid crystal at a g different from that of a driving circuit of a conventional liquid crystal panel, the response speed of the liquid crystal panel can be increased for all sorts of images including intermediate tone images to realize a bright and low-consumption color liquid crystal panel.

DETAILED DESCRIPTION OF THE PREFERRED EMBODIMENTS

Figure 1:
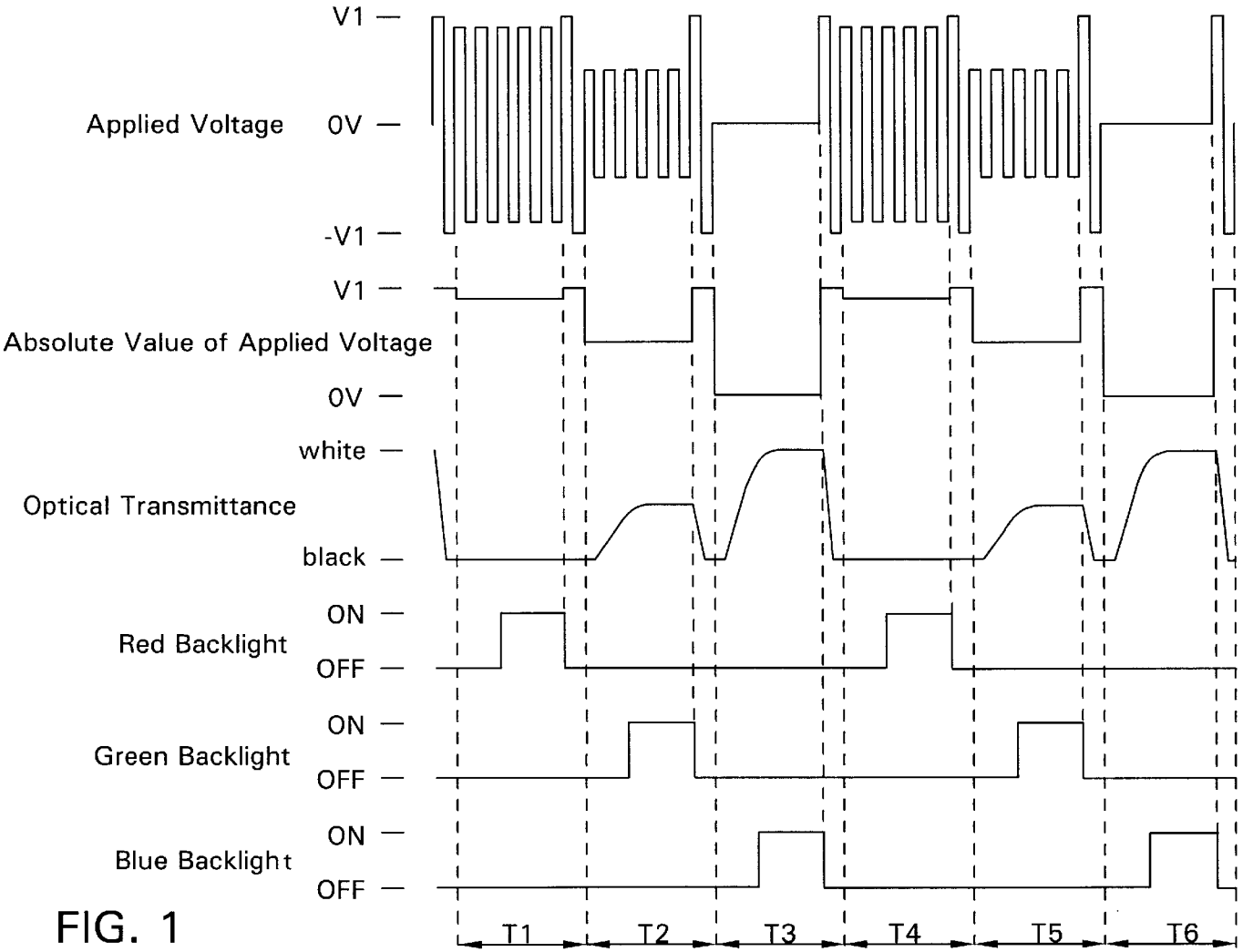
FIG. 1 is a diagram showing changes of optical transmittance with time, in response to changes in voltage applied to a liquid crystal, according to the invention.
Figure 2:
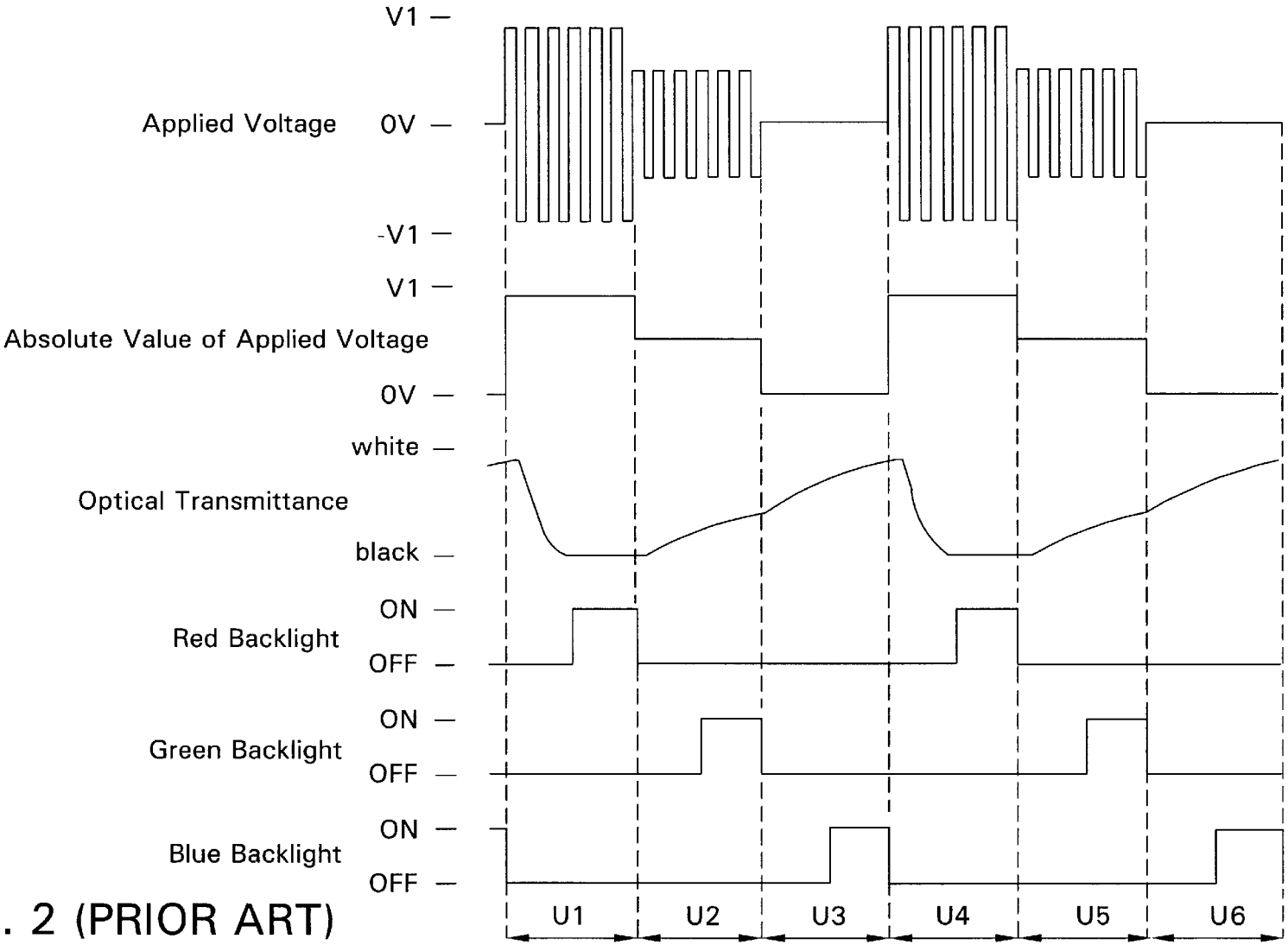
FIG. 2 (PRIOR ART)
FIG. 2 is a diagram showing changes of optical transmittance with time, in response to changes in voltage applied to a liquid crystal, in a conventional technique.
Figure 4:
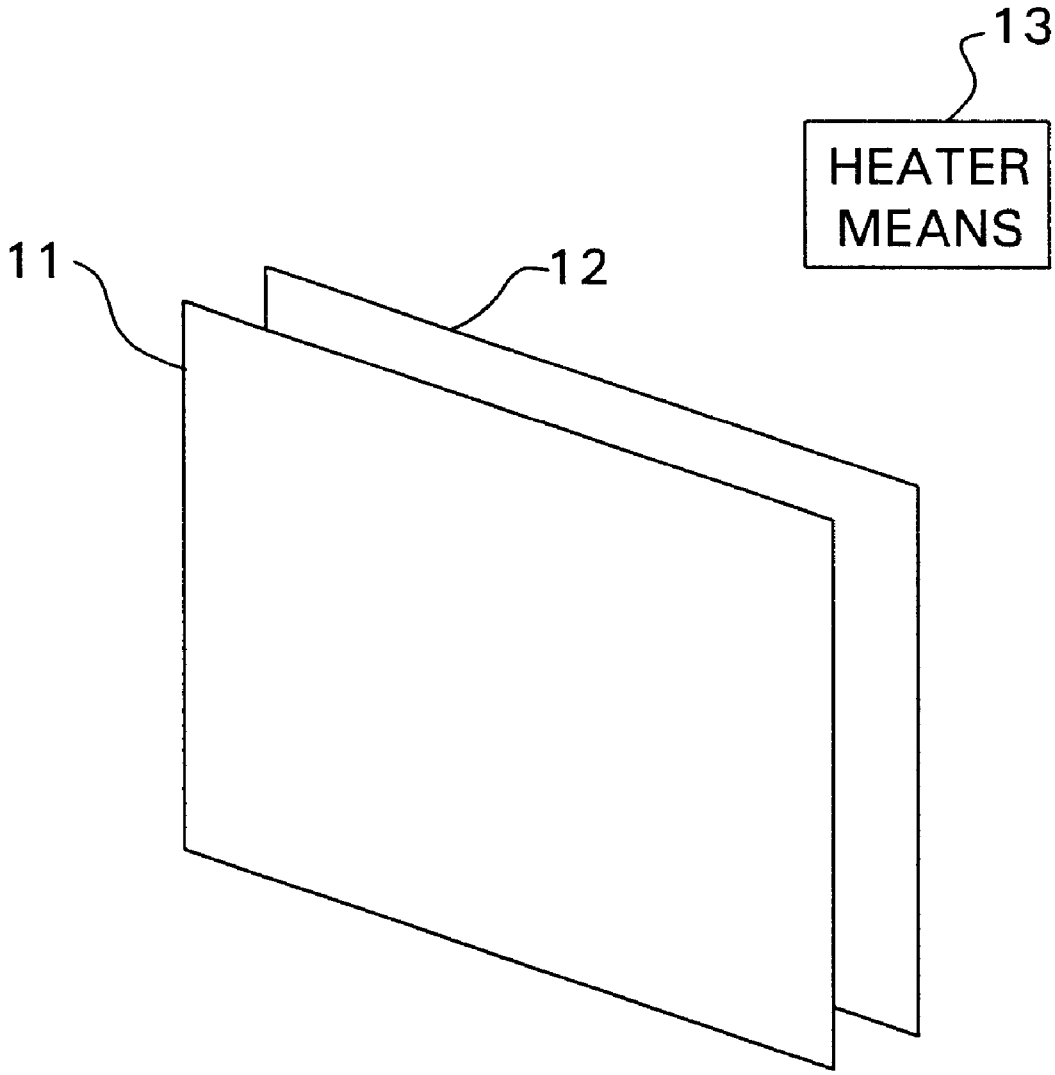
FIG. 4 is a schematic diagram of a liquid panel, an illuminator means and heater means.

FIG. 1 shows the waveform of a voltage applied to a normally white TN liquid crystal panel 11, its absolute value, changes in optical transmittance, ON-OFF timing of red, green and blue three-color back-lighting lamps, as a preferred embodiment of the invention. The back-lighting lamps are part of an illuminator means 12 for emitting the red, green and blue color light for the liquid crystal panel 11, as shown in FIG. 4. FIG. 2 shows corresponding materials in a conventional technique, namely, the waveform of a voltage applied to a normally white TN liquid crystal panel, its absolute value, changes in optical transmittance, ON-OFF timing of red, green and blue three-color back-lighting lamps.

FIG. 4 shows a heater means 13 acting as a heater to heat the liquid crystal to a predetermined value.

The TN liquid crystal panels used here are essentially the same as conventional TN liquid crystal panels in structure, but are optimized in TN liquid crystal material and cell gap, for example, to increase the response speed. The response speed can be readily increased by using the above-introduced method of using a TN liquid crystal panel with the cell gap of 2 $\mu$m, to 1 ms or less from white to black and approximately 2 ms from black to white in case of a normally white panel. Data of FIGS. 1 and 2 were obtained by using a common liquid crystal panel. Each duration of time T1 through T6 in FIG. 1 and each duration of time U1 through U6 in FIG. 2 are equal, namely, 5.5 ms which is the driving cycle of the liquid crystal panel required for color display by three-color back-lighting explained above.

Changes in optical transmittance with voltage applied to the liquid crystal panel are independent from the polarity of the applied voltage. However, the applied voltage is usually changed in polarity in predetermined intervals because continuous application of a d.c. voltage to the liquid crystal will cause electrochemical reaction and will deteriorate the liquid crystal. Therefore, also in the embodiment of the invention, the applied voltage is inverted in polarity. It should be noted, however, that inversion of polarities does not largely change the response speed of the liquid crystal. That is, it is substantial immaterial for high-speed driving of a liquid crystal, which is the object of the invention. Instead, in the present invention, the absolute value of the voltage applied to the liquid crystal panel is important regardless of its polarity. Now explained below is the operation of the embodiment of the invention while comparing FIG. 1 with FIG. 2.

It is generally known regarding the response speed of a liquid crystal panel that, when a voltage with a high absolute value is applied, the liquid crystal quickly responses even from an intermediate tone state.

In the driving method according to the embodiment shown in FIG. 1, a voltage is intentionally applied to the liquid crystal panel for a predetermined length of time at the end of each duration of time, T1 through T6, to adjust its absolute value to V1, independently from the voltage applied thereto and changing between V1 and 0V in absolute value in response to gradation data of images. When the voltage V1 is sufficiently high, the time required for changing to black from any transmittance can be reduced to 1 ms or less as explained above. In this case, not only the transmittance but also the state of liquid crystal molecules become substantially constant, and the state of transmittance in a certain duration of time does not affect the subsequent duration of time. Therefore, even if the transmittance is not returned to a normal state at the point of time where the backlight is changed ON, faithful display corresponding to the gradation data of the image for each corresponding duration of time is possible, and it can be prevented that the display is affected by gradation data of images for any other duration of time other than the corresponding duration of time. Additionally, since the response speed to gradation data of an intermediate tone never fails to change from the black state, the response speed can be stably reduced as compared with a change from an intermediate tone.

In the conventional driving method shown in FIG. 2, absolute values of the voltage applied in response to the gradation data of images are output, ranging from V1 to 0V, in respective durations of time U1 through U6. However, since the response speed from an intermediate tone is slower by several times as explained above, the liquid crystal cannot respond in time as short as 5.5 ms, depending upon gradation data. Comparing this with the embodiment of the present invention, display is affected not only by the gradation data of the corresponding duration of time but also by that of the precedent duration of time. Therefore, it was very difficult to display images corresponding to the gradation data for each duration of time in the cycle as short as 5.5 ms.

Figure 3:
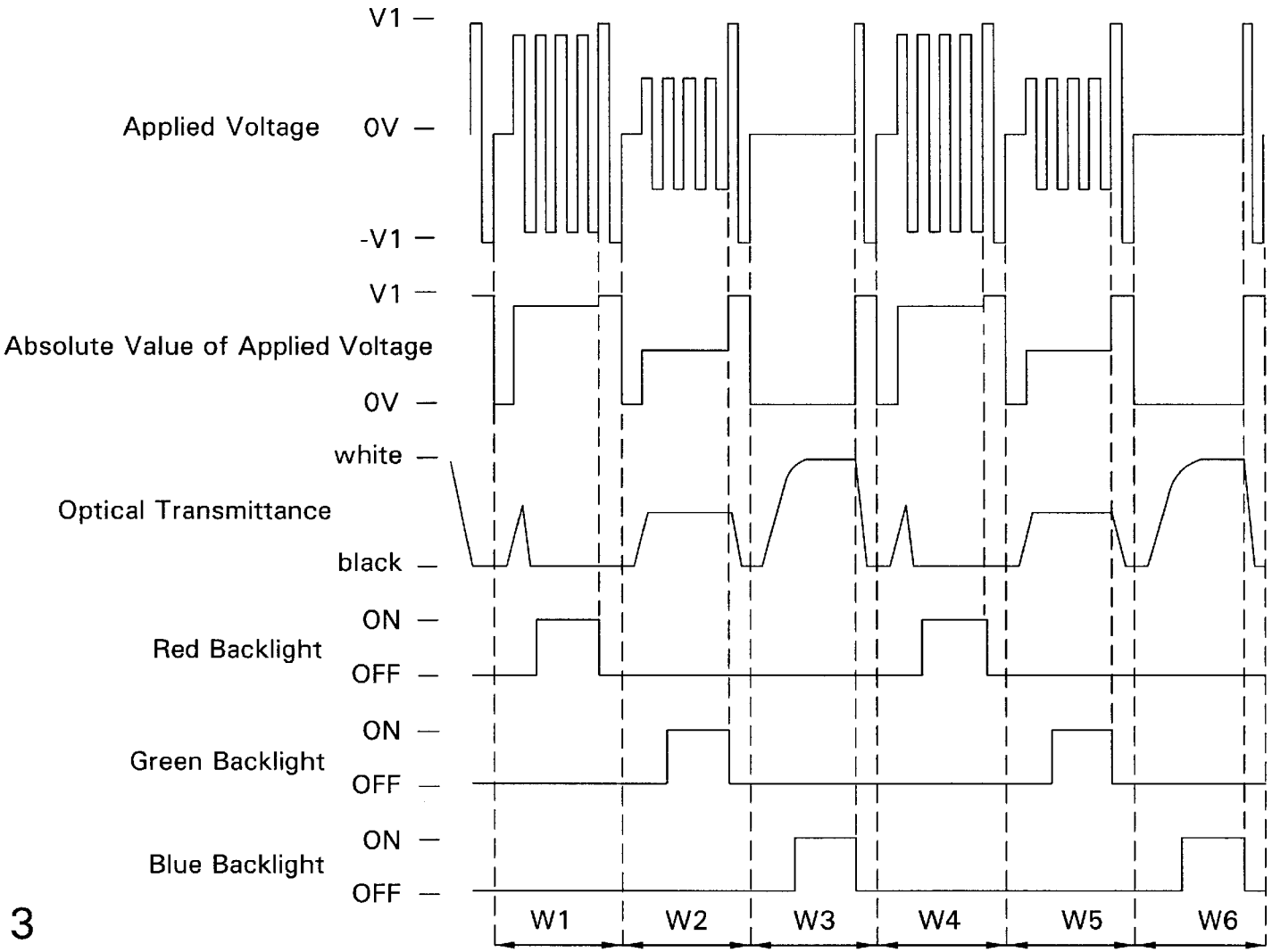
FIG. 3 is a diagram shot changes of optical transmittance with time, in response to changes in voltage applied to a liquid crystal, according to the invention.

FIG. 3 shows the waveform of a voltage applied to a normally white TN liquid crystal panel, its absolute value, changes in optical transmittance, ON-OFF timing of red, green and blue three-color back-lighting lamps, as another embodiment of the invention. The embodiment shown here is more improved in response speed of the liquid crystal panel as compared with the former embodiment shown in FIG. 1.

The TN liquid panel used in the embodiment of FIG. 3 is common to the liquid crystal panel used in the embodiment of FIG. 1 and the conventional technique of FIG. 2. W1 through W2 in FIG. 3 denote the same durations of time as those of T1 through T6 of FIG. 1, and each duration of time is 5.5 ms which is the driving cycle of the liquid crystal panel necessary for color display by three-color back-lighting. In the embodiment shown in FIG. 3, after a voltage is applied to the liquid crystal panel for a predetermined interval of time at the end of each duration of time, W1 to W6, to adjust the absolute value of the applied voltage to V1, an additional voltage is applied to the liquid crystal panel for a predetermined interval of time to adjust the absolute value of the applied voltage to 0V.

In general, response speeds of liquid crystal panels are higher upon changes from black to white than those upon changes from black to an intermediate tone. Therefore, by adjusting the applied voltage so that its absolute value be 0V for a predetermined time, the embodiment shown in FIG. 3 improves the response speed of the liquid crystal panel against intermediate tones more than the embodiment shown in FIG. 1.

In FIG. 3, transmittance of the liquid crystal panel may change for a time within a duration of time also when the gradation data of images is black, such as the durations of time W1 and W4. However, since the backlight is OFF, there is no influence for display.

Both embodiments of the invention, shown above, are configured to invert the polarity within each duration of time, T1 through T6 of FIG. 1 and W1 to W6 of FIG. 3, so that the average voltage of each duration of time becomes approximately 0V. This is under the following reasons. Namely, since the liquid crystal moves very quickly, if the polarity is inverted from a certain duration of time to another duration of time, flickers will occur due to a delicate difference between absolute values of the positive applied voltage and the negative applied voltage. Additionally, polarity inversion in very short intervals leads to improvement of instability in response speed of the liquid crystal panel caused by uneven gaps within the liquid crystal panel. Thus, the allowance for the gaps are enlarged, and the production yield of liquid crystal panels is improved.

The embodiments of the invention have been explained as employing a normally white liquid crystal panel which displays white under no applied voltage. However, the invention is similarly effective also when employing a normally black liquid crystal panel which displays black under no applied voltage. Furthermore, also with a special liquid crystal panel in which the relation between an applied voltage and optical transmittance of a liquid crystal is different from those of typical liquid crystal panels, similar effects are obtained by appropriately setting the value of a voltage applied in predetermined intervals independently from gradation data.

In order to ensure high-contrast images in the embodiments of the invention, it is important to change and return the transmittance of the liquid crystal panel within each duration of time.

Therefore, the frame cycle must be set appropriately in accordance with characteristics of the liquid crystal. If the frame cycle is excessively short, contrast will decrease. If the frame cycle is slow, flickers will occur.

The time required for the optical transmittance to return to the original value largely depends on the property of the liquid crystal material, particularly, the viscosity thereof. Therefore, it is recommended to select an appropriate liquid crystal whose optical transmittance quickly returns to the original value so as to ensure high-contrast display while preventing flickers.

As described above, since the invention employs a unique waveform of a voltage, the operation for displaying and completely erasing an image, including an intermediate tone image, can be completed in a very short time, and a very high response speed optimum for full-color moving images is promised.

Additionally, since the waveform of the applied voltage used in the invention is essentially the same as that of a liquid crystal used in a TFT system, the invention is also applicable to a TFT liquid crystal panel. Also in other driving methods, the invention is applicable to increase the response speed of a liquid crystal by adjusting the applied voltage to a predetermined voltage independent from gradation data in predetermined intervals for a predetermined length of time.

Furthermore, since the method according to the invention is configured to complete within one frame period operations from drawing an image on a panel to completely erasing the image, it is optimum for color display systems up three-color back-lighting, and can realize high-performance, low-cost color display devices.

What is claimed is:

1. A high-speed driving method of a liquid crystal for a liquid crystal display device comprising a liquid crystal and two electrodes sandwiching the liquid crystal to display images, the method comprising:

applying a voltage based on gradation data between the two electrodes for a portion of a predetermined interval; and applying a plurality of predetermined voltages different in absolute value and independent from the gradation data across the two electrodes, a first one of the predetermined voltages being applied for a different predetermined portion of the predetermined interval, the predetermined interval comprising an interval including a single backlight signal.

2. The high-speed driving method of a liquid crystal according to claim 1, including turning ON and OFF illumination once in the predetermined interval to provide the single backlight signal during a part of the portion of the interval that the voltage corresponding to the gradation data is applied.

3. The high-speed driving method of a liquid crystal according to claim 2, wherein the illumination is not applied during the portion of the predetermined interval that the first predetermined voltage independent from the gradation data is applied.

4. The high-speed driving method of a liquid crystal according to claim 1, including emitting red, green and blue color for the liquid crystal sequentially providing the single backlight signal having a single color during each one of the intervals.

5. The high-speed driving method of a liquid crystal according to claim 4, wherein colors are not applied during the portion of the predetermined interval that the first predetermined voltage independent from the gradation data is applied.

6. The high-speed driving method of a liquid crystal according to claim 1, wherein the voltage across the two electrodes is inverted in polarity within each said predetermined interval so that the average value of the voltage across the two electrodes is approximately 0 volts for each of the intervals.

7. The high-speed driving method of a liquid crystal according to claim 1, wherein an absolute value of the first predetermined voltage is larger than a maximum value among absolute values of the voltage based on the gradation data.

8. The high-speed driving method of a liquid crystal according to claim 1, including the step of heating the liquid crystal to a predetermined temperature value.

9. A high-speed driving method of a TN liquid crystal for a liquid crystal display device comprising a TN liquid crystal and two electrodes sandwiching the liquid crystal to display images comprising:

applying a voltage based on gradation data between the two electrodes during a first predetermined length of time of a predetermined interval; and applying at least first and second predetermined voltages different in absolute value and independent from the gradation data across the two electrodes for second and third predetermined lengths of time, the at least second and third predetermined lengths of time being separate from the first length of time such that the first predetermined length of time and the at least second and third separate lengths of time equal the predetermined interval.

10. The high-speed driving method of a TN liquid crystal according to claim 9, including the step of illuminating the liquid crystal ON and OFF during each of the predetermined intervals.

11. The high-speed driving method of a TN liquid crystal according to claim 10, wherein illuminating of the liquid crystal is turned OFF when the at least first and second predetermined voltages independent from the gradation data are applied.

12. The high-speed driving method of a TN liquid crystal according to claim 9, including the step of emitting red, green and blue colors for the liquid crystal sequentially by providing a single color during each of the predetermined time intervals.

13. The high-speed driving method of a TN liquid crystal according to claim 12, wherein the colors are not applied when the at least second and third predetermined voltages independent from the gradation data are applied.

14. The high-speed driving method of a TN liquid crystal according to claim 9, wherein the voltage across the two electrodes is inverted in polarity within each said predetermined interval so that the average value of the voltage across the two electrodes is approximately 0 volts for each of the predetermined intervals.

15. The high-speed driving method of a TN liquid crystal according to claim 9, wherein an absolute value of at least one of the predetermined voltages is larger than a maximum value among absolute values of the voltage based on the gradation data.

16. The high-speed driving method of a TN liquid crystal according to claim 9, including the step of heating the liquid crystal to a predetermined temperature value.

17. The high-speed driving method of a TN liquid crystal according to claim 9, wherein each predetermined interval is defined as a time period including a single backlight signal.

18. A high-speed driving method of a liquid crystal for an active matrix liquid crystal display device having a plurality of elements in the form of a matrix, each said element including a liquid crystal, two electrodes sandwiching the liquid crystal and an active device connected to one of the electrodes, the method including the steps of displaying images by applying a voltage based on gradation data between the two electrodes for a first predetermined length of time of a predetermined interval, and applying at least a second predetermined voltage different in absolute value and independent from the gradation data across the two electrodes for a second predetermined length of time in the predetermined interval, the second predetermined length of time being separate from the first predetermined length of time.

19. The highspeed driving method of a liquid crystal according to claim 18, including the step of illuminating the liquid crystal during a portion of the first predetermined length of time.

20. The high-speed driving method of a liquid crystal according to claim 19, including not illuminating the liquid crystal during the second predetermined length of time for applying the second predetermined voltage independent from the gradation data.

21. The high-speed driving method of a liquid crystal according to claim 18, including the step of emitting red, green and blue colors to the liquid crystal separately and sequentially by providing one of the colors during each of the predetermined intervals.

22. The high-speed driving method of a liquid crystal according to claim 21, wherein the colors are not applied during the second predetermined length of time the second predetermined voltage independent from the gradation data is applied.

23. The high-speed driving method of a liquid crystal according to claim 18, wherein the voltage across the two electrodes is inverted in polarity within each said predetermined interval to provide an average value of the voltage across the two electrodes of approximately 0 volts for each of the intervals.

24. The high-speed driving method of a liquid crystal according to claim 18, wherein an absolute value of the second predetermined voltage is larger than the maximum value among absolute values of the voltage based on the gradation data.

25. The high-speed driving method of a liquid crystal according to claim 18, including the step of heating the liquid crystal to a predetermined temperature value.

26. The high-speed driving method of a liquid crystal according to claim 18, wherein each predetermined interval is defined as a time period including a single backlight signal.

27. A high-speed method of driving a liquid crystal display panel having liquid crystals sandwiched by pairs of electrodes to display images, comprising the steps of:

applying in sequence differently colored backlight signals to the electrodes during predetermined time intervals, the colored backlight signals corresponding to the predetermined time intervals such that a single one of the colored backlight signals is applied during each of the time intervals, the colored backlight signals each being provided for a first predetermined length of time which is less than the corresponding time interval;

applying a display voltage across the pairs of electrodes based on gradation data for a second predetermined length of time during each of the time intervals, the display voltage varying for each of the time intervals based on the gradation data; and applying an independent voltage across the pairs of electrodes independent from the display voltage for a third predetermined length of time during each of the time intervals, the independent voltage applied having the same voltage value for each of the predetermined intervals.

28. The high-speed driving method of claim 27, wherein the step of providing in sequence the differently colored backlight signals to the liquid crystals comprises providing the colors red, green and blue in sequence and then repeating the sequence of colors.

29. The high-speed driving method of claim 27, wherein the step of applying the independent voltage across the electrodes for the third predetermined length of time results in the optical transmittance of the liquid crystal returning to or remaining black during a portion of each of the predetermined intervals.

30. The high-speed driving method of claim 27, wherein the step of applying the independent voltage across the electrodes for the third predetermined length of time results in the optical transmittance of the liquid crystal returning to or remaining white during a portion of each of the predetermined intervals.

31. The high-speed driving method of claim 27, wherein the step of applying the independent voltage independent from the display voltage across the electrodes for the third predetermined length of time includes beginning application of the independent voltage when the first predetermined length of time that the backlight signals are applied ends.

32. The high-speed driving method of claim 27, wherein the independent voltage applied to the electrodes comprises a first independent voltage, the method including the step of applying a second independent voltage independent from the display voltage and having an absolute value of zero volts across the electrodes for a fourth predetermined length of time, the fourth predetermined length of time being a first portion of the predetermined interval separate from a second portion of the predetermined interval when the first independent voltage is applied for the third predetermined length of time.

33. An active matrix liquid crystal display device having a plurality of elements in the form of a matrix, each said element comprising:

a liquid crystal;

two electrodes sandwiching the liquid crystal; and an active device connected to said electrodes to display images by applying a display voltage between the electrodes based on gradation data for a first time period within a predetermined interval and applying an independent voltage independent from the display voltage between the electrodes for a second time period separate from the first time period within the predetermined time interval;

wherein an illuminator sequentially emits red, green and blue colors to the liquid crystal, a single one of the three colors being emitted during the predetermined time interval.

34. The active matrix liquid crystal display device of claim 33, wherein the independent voltage comprises a first, independent voltage and the active device applies a second independent voltage independent from the gradation data for a third time period within the predetermined time interval, the third time period being separate from the first and second time periods.

35. The active matrix liquid crystal display device of claim 33, wherein the single one of the three colors is emitted to the liquid crystal during part of the predetermined time interval when the display voltage is applied to the electrodes and the single one of the three colors is not emitted when the first independent voltage is applied to the electrodes.

* * * * *